US005996456A

United States Patent [19]

Streck

[11] Patent Number: 5,996,456

[45] Date of Patent: Dec. 7, 1999

[54] PUNCHING APPARATUS

[75] Inventor: Hans-Dieter Streck, Schalksmühle, Germany

[73] Assignee: CFS Falkenroth Umformtechnik GmbH & Co., Schalksmuhle, Germany

[21] Appl. No.: 09/113,846

[22] Filed: Jul. 10, 1998

[51] Int. Cl.[6] ..... B26D 7/18

[52] U.S. Cl. ..... 83/123; 83/112; 83/51; 83/12; 83/165; 83/137; 83/456; 83/465; 83/560; 83/639.1

[58] Field of Search ..... 83/456, DIG. 1, 83/DIG. 2, DIG. 3, 465, 560, 562, 639.5, 51, 137, 129, 123, 102, 112, 150, 165, 639.1

[56] References Cited

U.S. PATENT DOCUMENTS

| | | | |
|---|---|---|---|
| 2,518,433 | 8/1950 | Friedman | 83/123 |
| 4,136,592 | 1/1979 | Beatty | 83/560 |
| 4,463,637 | 8/1984 | Delio et al. | 83/456 |
| 5,553,525 | 9/1996 | Mailey et al. | 83/560 |

FOREIGN PATENT DOCUMENTS

| | | | |
|---|---|---|---|
| 780731 | 8/1957 | United Kingdom | 83/129 |

*Primary Examiner*—Rinaldi I. Rada
*Assistant Examiner*—Dominic Troiano
*Attorney, Agent, or Firm*—Herbert Dubno; Andrew Wilford

[57] ABSTRACT

An apparatus for punching transversely throughgoing coaxial holes in spaced walls of a workpiece has a holder supporting the workpiece and an outer tool part formed with a pair of transverse bores and displaceable between an advanced position engaged over the workpiece on the holder and outwardly flanking the walls and a retracted position spaced from the holder. An inner tool part formed with a transversely throughgoing bore is displaceable in the advanced position of the outer tool part between an advanced position engaged between the walls and with its bore coaxial with the bores of the outer tool part and a retracted position with its bore spaced from the workpiece in the holder. The outer tool part is formed with a waste passage aligned with the inner-part bore in the retracted position of the inner part. Respective punches are axially displaceable in the outer-part bores in the advanced positions of the tool parts to punch a respective piece from the respective wall and push the punched-out piece into the bore of the inner tool part. A knockout element can be pushed in the retracted position of the inner tool part into the inner-part bore by an actuator to push the piece therein into the waste passage.

6 Claims, 5 Drawing Sheets

PUNCHING APPARATUS

SPECIFICATION

1. Field of the Invention

The present invention relates to a punching apparatus. More particularly this invention concerns an apparatus for the hot calibrating and punching of holes in a workpiece.

2. Background of the Invention

In the hot formation of various machine parts, for instance piston rods, it is frequently necessary to form accurately dimensioned transverse holes in the workpiece. This is most easily done when the workpiece is still hot, often 1050° C. to 1100° C. for aluminum, and the most accurate holes are produced most efficiently by punching.

When the workpiece requires two coaxial holes in opposite arms or walls that are relatively closely spaced, it is fairly difficult to create the holes without deforming the workpiece. The arms must be supported as each of the holes is driven, typically by an insert that is fitted between the arms. This insert has an inner hole big enough to receive the punched-out piece, and the operation must be carried out horizontally, that is by punching down, to ensure that the punched-out piece drops into the insert. When the arms are relatively closely spaced, the insert cannot be made strong enough to withstand the force of the punching operation so that the workpiece is detrimentally deformed. During such an operation which requires repositioning the workpiece to punch out the second side, valuable time is lost and the workpiece can cool excessively. Furthermore the arm being punched is not supported around the edges of the hole where the punch pushes through, often leading to a ragged formation or push-through.

OBJECTS OF THE INVENTION

It is therefore an object of the present invention to provide an improved apparatus for punching transversely throughgoing coaxial holes in spaced walls of a workpiece.

Another object is the provision of such an improved apparatus for punching transversely throughgoing coaxial holes in spaced walls of a workpiece which overcomes the above-given disadvantages, that is which is extremely fast and simple so that it can be applied readily to a high-volume mass-production operation.

SUMMARY OF THE INVENTION

An apparatus for punching transversely throughgoing coaxial holes in spaced walls of a workpiece has according to the invention a holder supporting the workpiece and an outer tool part formed with a pair of transverse bores and displaceable between an advanced position engaged over the workpiece on the holder and outwardly flanking the walls and a retracted position spaced from the workpiece and holder. An inner tool part formed with a transversely throughgoing bore is displaceable in the advanced position of the outer tool part between an advanced position engaged between the walls and with its bore coaxial with the bores of the outer tool part and a retracted position with its bore spaced from the workpiece in the holder. The outer tool part is formed with a waste passage aligned with the inner-part bore in the retracted position of the inner part. Respective punches are axially displaceable in the outer-part bores in the advanced positions of the tool parts to punch a respective piece from the respective wall and push the punched-out piece into the bore of the inner tool part. A knockout element can be pushed in the retracted position of the inner tool part into the inner-part bore by an actuator to push the piece therein into the waste passage.

Thus with this system it is merely necessary to advance the two parts so they fit solidly and complementarily around the walls of the workpiece. Then at least one of the punches is driven through the respective wall to form a hole therein and to push the punched-out piece into the bore of the inner part. This inner part is then withdrawn, the piece is knocked out of it into the waste passage, and if necessary it is again advanced to repeat the operation with the other wall. The entire cycle can take place in a few seconds and both walls of the workpiece are solidly supported throughout. Thus there is no stress to the workpiece and no time for it to cool off. In fact the complementary fit of the parts with the workpiece can serve to true its shape, and to ensure that the produced bores are perfectly coaxial.

According to the invention the apparatus has two such knockout elements flanking the inner part and coaxially displaceable in the outer part. In addition the outer part is formed with two such waste passages, one to each side of the inner part.

Respective inner and outer hydraulic actuators connected to the inner and outer tool parts are operable to displace same between the respective advanced and retracted positions. Furthermore the means for axially displacing the punches and the actuator for the knockout element are all hydraulic actuators.

The workpiece is releasably secured to the support and one or both of the parts has a removable end piece complementarily fittable with the workpiece. Thus when the tool parts are fitted to the workpiece, it is totally supported and cannot move at all when being punched, ensuring that the punched hole will be perfectly accurate.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
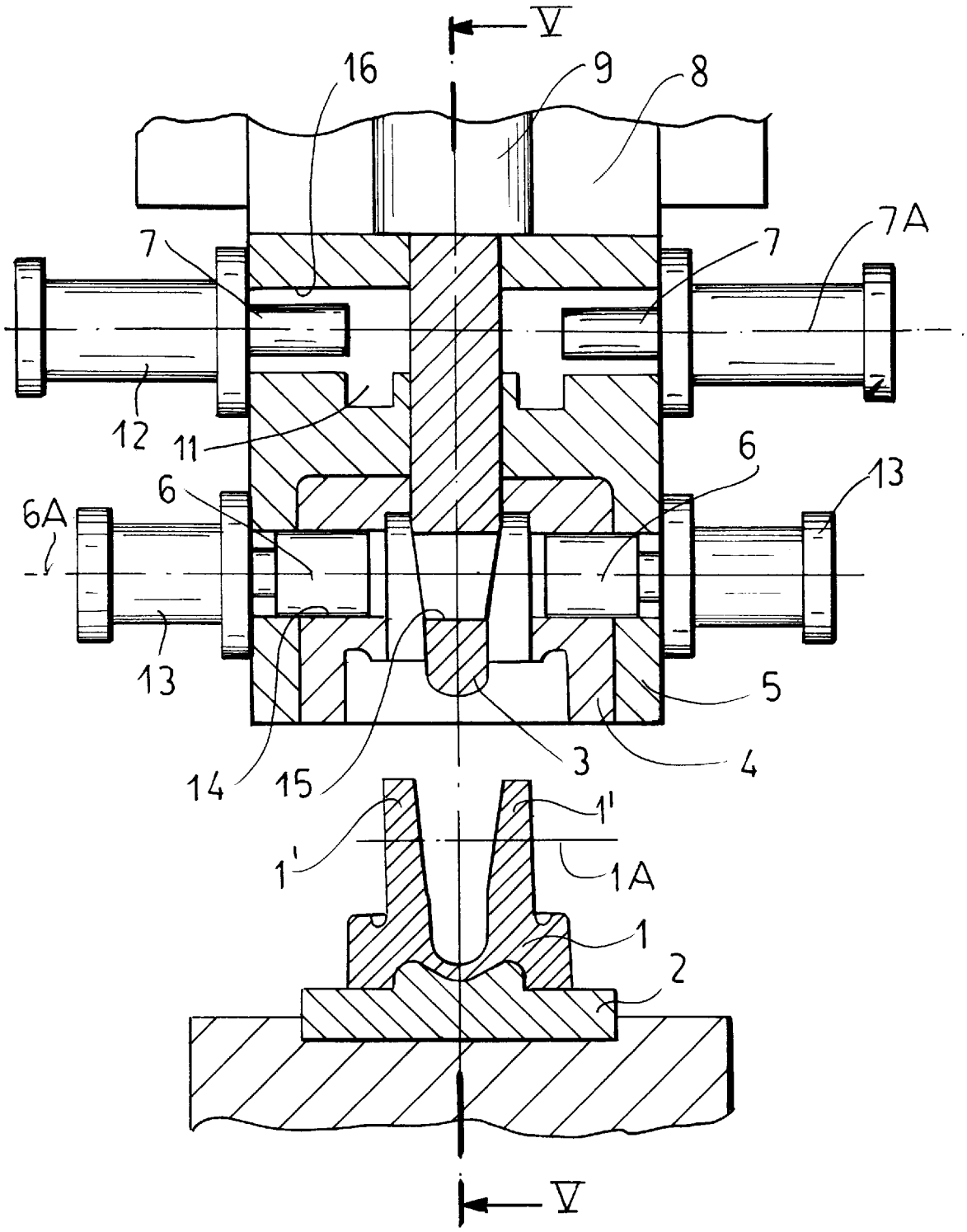
FIG. 1 is a section through the apparatus according to the invention before the start of a punching operation.
Figure 5:
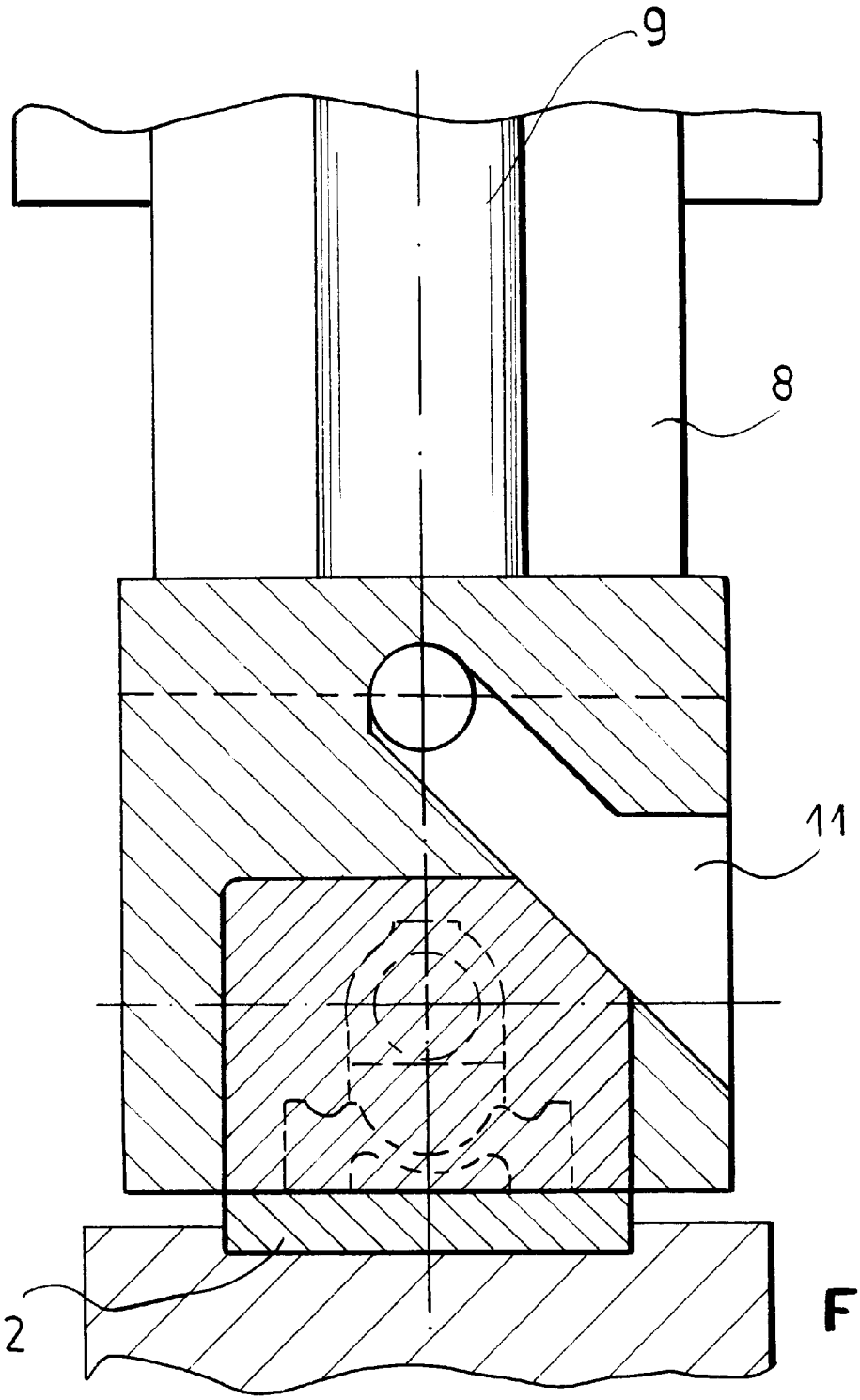
FIG. 5 is section taken along line V—V of FIG. 1.

As seen in FIGS. 1 and 5 a workpiece 1, here the piston end of a piston rod, has a pair of arms or walls 1' and is formed of cast metal, typically steel or aluminum. While still hot it needs to be formed with a pair of aligned cylindrical bores along an axis 1A which will eventually receive a pin on which a piston is mounted. This workpiece 1 is mounted on a removable complementarily shaped holder or end piece 2 with the axis 1A normally horizontal.

The hole-punching apparatus comprises an outer tool part 5 having a core 4 that fits complementarily around the two walls 1' of the workpiece 1. This outer part 4, 5 can be displaced between the retracted position of FIG. 1 and the advanced positions of FIGS. 2 through 4 by an outer actuator 8. It is formed with a pair of coaxial horizontal bores 14 in each of which is slidable a punch 6 of the exact cylindrical size and shape as the holes to be formed in the walls 1' of the workpiece 1. These punches 6 are coaxial on an axis 6A and are each associated with a heavy-duty hydraulic actuator 13 mounted right on the outer part 5. In the advanced position the outer part 4, 5 fits snugly over the workpiece 1 with the axis 6A aligned with the axis 1A where holes are to be formed.

Figure 2:
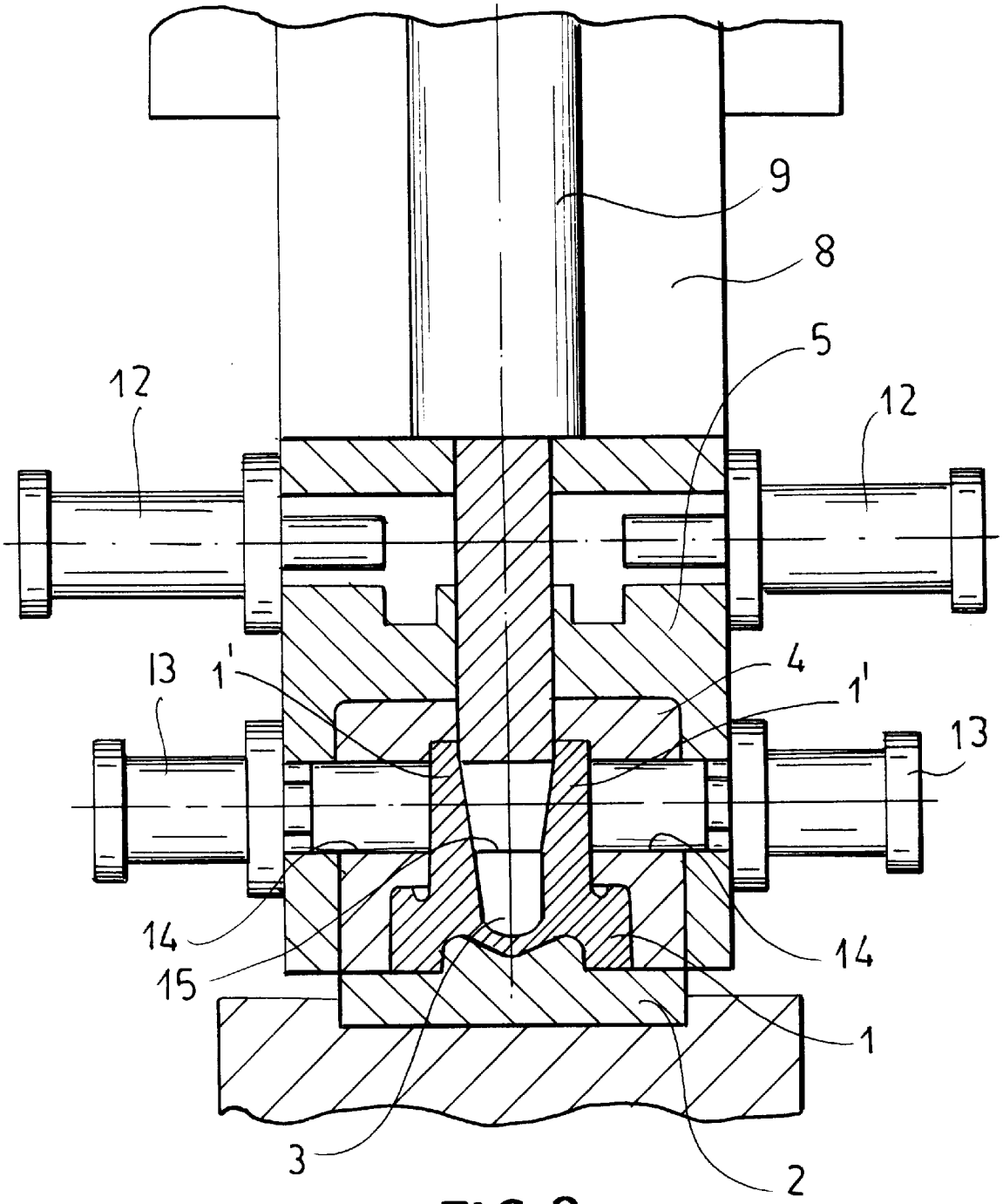
FIGS. 2 through 4 are views like FIG. 1 showing succeeding steps in the punching operation.
Figure 3:
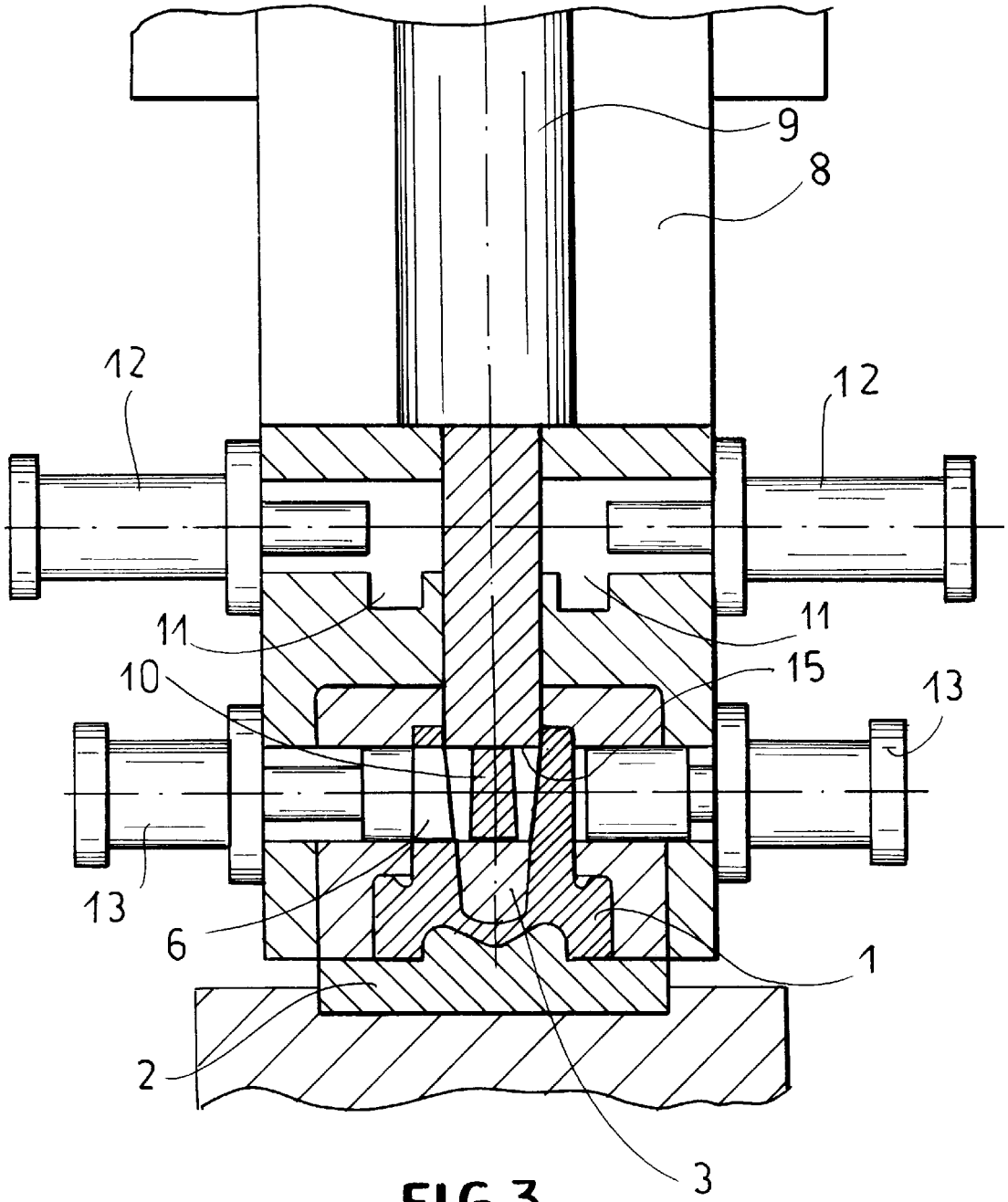

In addition the apparatus has an inner tool part 3 that is displaceable in the outer part 4, 5 and that is formed with a throughgoing bore 15 of the same size and shape as the bores 14 and in fact alignable in an advanced position shown in FIGS. 1 through 3 with the bores 14. This part 3 fits complementarily between the walls 1' of the workpiece 1 in the advanced positions. In a retracted position the bore 15 is aligned with an axially throughgoing passage 16 which is formed to each side of the inner part 3 with a waste passage 11 opening outside the part. An actuator 9 inside the actuator 8 displaces the inner part 3 relative to the outer part 4, 5 in the advanced position of the latter.

The outer part 4, 5 carries a pair of actuators 12 carrying respective knockout elements or pins 7 that are coaxial on an axis 7A parallel to the axis 6A and also constituting the axis of the passage 16. These knockout pins 7 can be advanced from opposite sides into the inner-part bore 15 in the retracted position of same.

The apparatus described above functions as follows:

To start with as shown in FIG. 1 the workpiece 1 is fitted to the stationary holder 2 and the parts 3 and 4, 5 are spaced from it in the retracted positions.

Then as shown in FIG. 2 the outer part 4, 5 and the inner part 3 are advanced jointly to the advanced positions with the part 4, 5 fitting snugly around the workpiece 1 and the inner part 3 fitting snugly between its walls 1'. The cylindrical bores 14 and 15 are coaxially aligned.

According to FIG. 3 then one or the other of the actuators 13 advances to punch through the respective wall 1' and force a piece 10 therefrom into the bore 15. If the space between the walls 1' were wide enough, it would be possible to punch out both walls 1' simultaneously but this is not normally possible.

Figure 4:
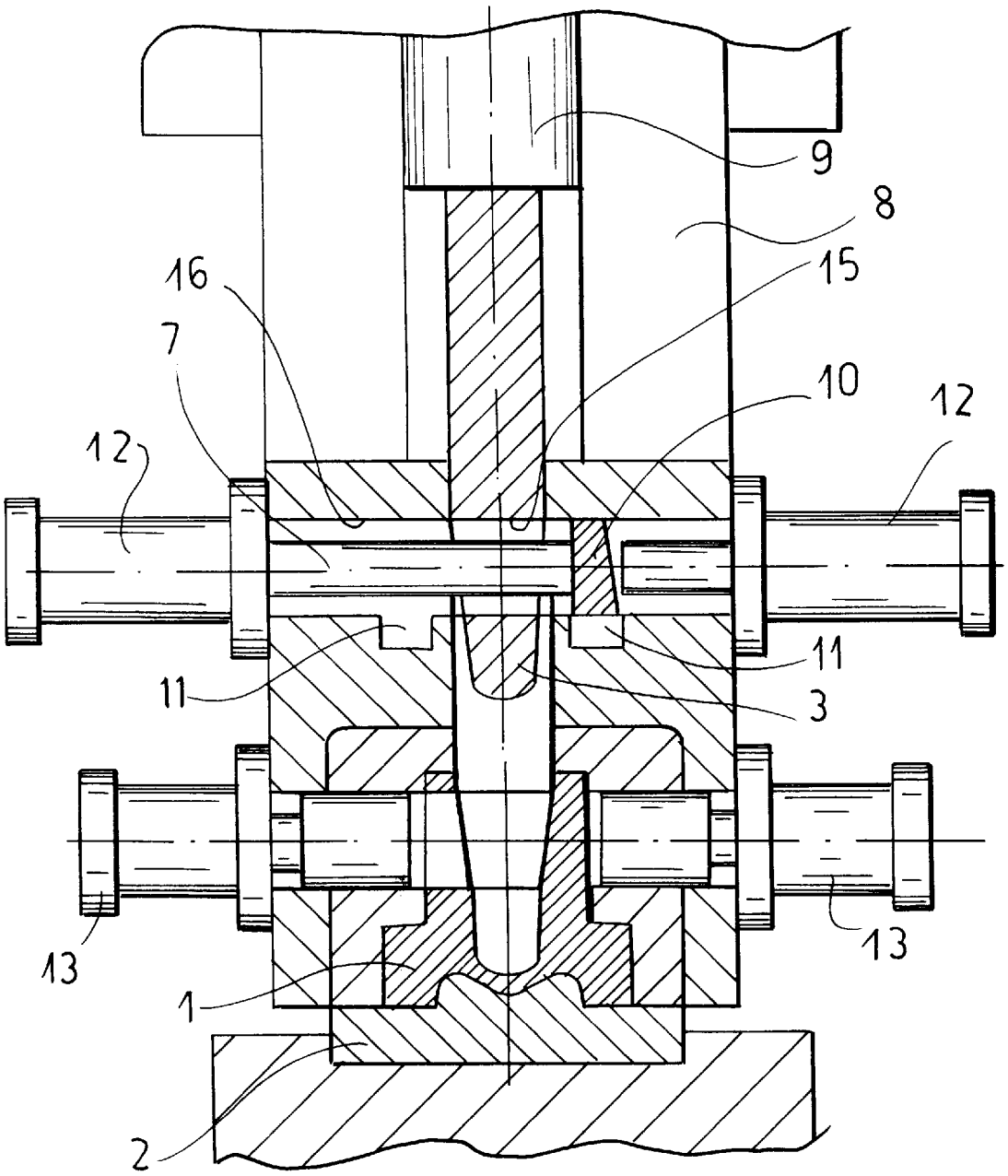

The inner part 3 is then raised as shown in FIG. 4 until its bore 15 is aligned with the bores 16 and the actuator 12 on the same side as the actuator 13 just operated is operated to advance the respective knockout pin 7 and push the piece 10 over to the waste passage 11 whence it drops out of the machine. Two such actuators 12 and punches 7 are needed since the punched-out piece 10 has one side perpendicular the axis 7A and another side angled thereto so that if it were pushed by the angled side it might jam in the bore 15.

The inner part 3 is then lowered and the cycle is repeated with the punch 6 and pin 7 on the other side of the machine to punch a similar hole in the other wall 1' of the workpiece 1.

I claim:

1. An apparatus for punching transversely throughgoing coaxial holes in spaced walls of a workpiece, the apparatus comprising:

a holder supporting the workpiece;

an outer tool part formed with a pair of transverse bores and displaceable between an advanced position engaged over the workpiece on the holder and outwardly flanking the walls and a retracted position spaced from the holder;

an inner tool part formed with a transversely throughgoing bore and displaceable in the advanced position of the outer tool part between an advanced position engaged between the walls and with its bore coaxial with the bores of the outer tool part and a retracted position with its bore spaced from the workpiece in the holder, the outer tool part being formed with a waste passage aligned with the inner-part bore in the retracted position of the inner part;

respective punches axially displaceable in the outer-part bores;

means for axially displacing each the punches in the outer-part bores in the advanced positions of the inner and outer tool parts and thereby punching a respective piece from the respective wall and pushing the punched-out piece into the bore of the inner tool part;

a knockout element engageable in the retracted position of the inner tool part in the inner-part bore; and means including an actuator connected to the knockout element for advancing same through the inner-part bore and thereby pushing the piece therein into the waste passage.

2. The punching apparatus defined in claim 1 wherein the apparatus has two such knockout elements flanking the inner part and coaxially displaceable in the outer part, the outer part being formed with two such waste passages, one to each side of the inner part.

3. The punching apparatus defined in claim 1 further comprising means including respective inner and outer hydraulic actuators connected to the inner and outer tool parts for displacing the inner and outer tool parts between the respective advanced and retracted positions.

4. The punching apparatus defined in claim 1 wherein the means for axially displacing the punches and the actuator for the knockout element are all hydraulic actuators.

5. The punching apparatus defined in claim 1 wherein the workpiece is releasably secured to the support.

6. The punching apparatus defined in claim 1 wherein the inner and outer parts fit complementarily with the workpiece.

* * * * *